US007020900B2

(12) United States Patent
Ngan

(10) Patent No.: US 7,020,900 B2
(45) Date of Patent: Apr. 4, 2006

(54) ELASTICALLY RETAINED HAT AND BAND

(75) Inventor: Jacky Ngan, Kowloon (HK)

(73) Assignee: Universal Hats & Caps Mfg., Ltd, Hunghom (HK)

( * ) Notice: Subject to any disclaimer, the term of this patent is extended or adjusted under 35 U.S.C. 154(b) by 130 days.

(21) Appl. No.: 10/412,468

(22) Filed: Apr. 11, 2003

(65) Prior Publication Data

US 2004/0199979 A1 Oct. 14, 2004

(51) Int. Cl.
*A42B 1/00* (2006.01)

(52) U.S. Cl. ..... 2/181

(58) Field of Classification Search ..... 2/181, 2/181.2, 181.4, DIG. 1, 1, 311, 338, 220, 2/221, 236, 237; 428/192, 193, 212; 442/183, 442/306, 182

See application file for complete search history.

(56) References Cited

U.S. PATENT DOCUMENTS

| | | | | |
|---|---|---|---|---|
| 1,748,375 | A | 2/1930 | Wittcoff | |
| 2,338,243 | A * | 1/1944 | Hawley, Jr. | 442/183 |
| 2,403,786 | A | 7/1946 | Campbell | |
| 3,029,438 | A | 4/1962 | Henschel | |
| 4,642,817 | A | 2/1987 | Ferstenfeld | 2/183 |
| 5,428,843 | A | 7/1995 | Clowers et al. | |
| 5,483,702 | A * | 1/1996 | D'Ambrosio | 2/237 |
| 5,794,769 | A * | 8/1998 | Tomlinson et al. | 206/69 |
| 5,966,742 | A | 10/1999 | Cunliffe | 2/195.3 |
| 6,049,911 | A | 4/2000 | Bromberg | 2/195.3 |
| 6,131,202 | A | 10/2000 | Yan | 2/195.3 |
| 6,199,213 | B1 | 3/2001 | Whang | 2/181 |
| 6,347,410 | B1 | 2/2002 | Lee | 2/181 |
| 6,446,266 | B1 | 9/2002 | Park | 2/195.1 |
| 6,499,144 | B1 * | 12/2002 | Yan | 2/181.2 |
| 6,701,532 | B1 * | 3/2004 | Glassberg et al. | 2/170 |
| 2003/0037365 | A1 * | 2/2003 | Wilson | 2/181 |
| 2003/0226192 | A1 | 12/2003 | Wang | |
| 2004/0019955 | A1 * | 2/2004 | Morris et al. | 2/221 |

FOREIGN PATENT DOCUMENTS

| | | |
|---|---|---|
| GB | 512261 | 8/1939 |
| WO | WO99/52386 | 10/1999 |

* cited by examiner

*Primary Examiner*—Katherine M. Moran
(74) *Attorney, Agent, or Firm*—Gordon & Jacobson, P.C.

(57) ABSTRACT

A hat includes an elasticized band that extends around the periphery of the hat's crown to retain the hat on the head of a wearer. The elasticity of the band in a longitudinal direction is not uniform across its width. Instead the elasticity is greater in one region proximate one edge of the band than it is in a second region proximate the opposite edge of the band. The band is comfortable for the wearer because it grips the wearer's head less tightly in the second region than in the first region. At the same time, the entire width of the band contributes to retaining the hat on wearer's head. The band can also be used to retain other garments on a wearer.

21 Claims, 5 Drawing Sheets

ELASTICALLY RETAINED HAT AND BAND

FIELD OF THE INVENTION

The present invention relates to hats, and more particularly to hats that include an elasticized band to retain the hat on a wearer's head.

BACKGROUND OF THE INVENTION

Hats protect wearers from the weather. Additionally, they are a popular fashion accessory. In recent years, formal hats like fedoras and top hats have become less popular, while casual headwear has become more popular. For example, baseball caps and the like are currently very popular.

Casual headwear is often used during sporting activities. As such, it is not uncommon to incorporate a sweatband into these hats.

As well, many casual hats are designed so as not to become dislodged during activities, while also being designed to be quickly put on and taken off. To allow this, many hats are held in place by an elasticized band. The elasticized band typically extends along the inner periphery of the crown of the hat. As the band is usually the sole mechanism affixing the hat to the wearer, it is typically tight. Often this causes discomfort to the wearer.

Accordingly, there is a need for headwear that fits a wearer snugly, without causing discomfort.

SUMMARY OF THE INVENTION

Accordingly, the invention provides a hat that is retained on a wearer's head by a elasticized band that extends around the periphery of the hat's crown. The elasticity of the band in a longitudinal direction is not uniform across its width. Instead the elasticity is greater in one region proximate one edge of the band than it is in a second region proximate the opposite edge of the band. The band is comfortable for the wearer because it grips the wearer's head less tightly in the second region than in the first region. At the same time, the resiliency across the entire width of the band contributes to retaining the hat on wearer's head. The band can also be used to retain other garments on a wearer.

In accordance with one aspect of the invention, there is provided a hat including: an elasticized band, having first and second opposing edges and a longitudinal extent. The elasticized band is formed of a material to provide a first resiliency along a direction of the longitudinal extent, in a first region proximate the first edge, and a second resiliency, differing from the first resiliency, along the longitudinal direction in a second region proximate the second edge. A crown defines a cavity to accommodate a wearer's head and having an interior surface and a lower peripheral edge. The elasticized band is attached proximate the lower peripheral edge, to extend along a periphery of the crown to elastically retain the hat when worn on a wearer's head and to grasp the wearer's head more tightly at the first region than at the second region.

In accordance with a further aspect of the invention, there is provided an elasticized band for retaining garments on a wearer, including: a first lengthwise extending band portion having a first elasticity in a lengthwise direction, and extending from a first edge of the band, a second lengthwise extending band portion, extending directly from the first band portion along its length to a second edge of the band, and having a second elasticity in a lengthwise direction, the first elasticity being of tighter contraction than the second elasticity.

In accordance with another aspect of the invention, there is provided a hat including: an elasticized band, having first and second opposing edges, a longitudinal extent and first and second distal ends, a crown defining a cavity to accommodate a wearer's head and having an interior surface and a lower peripheral edge, the elasticized band attached proximate the lower peripheral edge, to extend along a periphery of the crown to elastically retain the hat when worn on a wearer's head, a fabric patch, having thickness less than a thickness of the elasticized band, and connecting the first and second distal ends of the band, the fabric patch having a length of no more than 25% of the longitudinal extent of the elasticized band.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of this invention.

DETAILED DESCRIPTION

Figure 1:
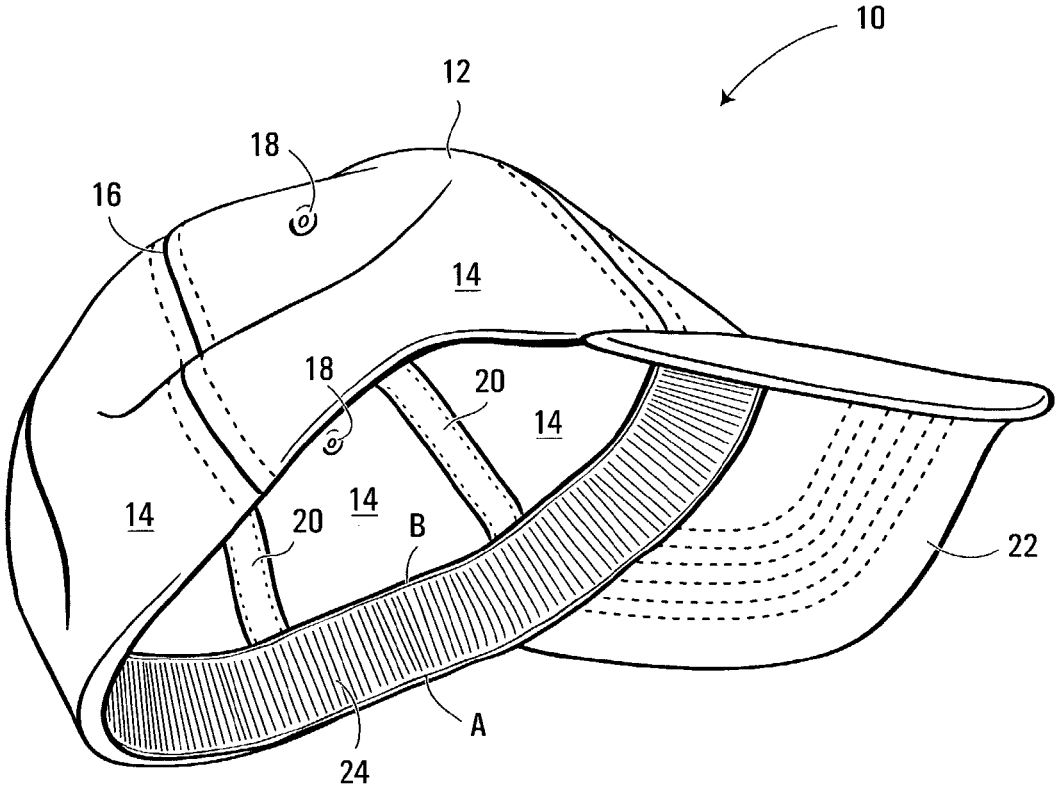
FIG. 1 is a bottom left perspective view of a hat, exemplary of an embodiment of the present invention.
Figure 2:
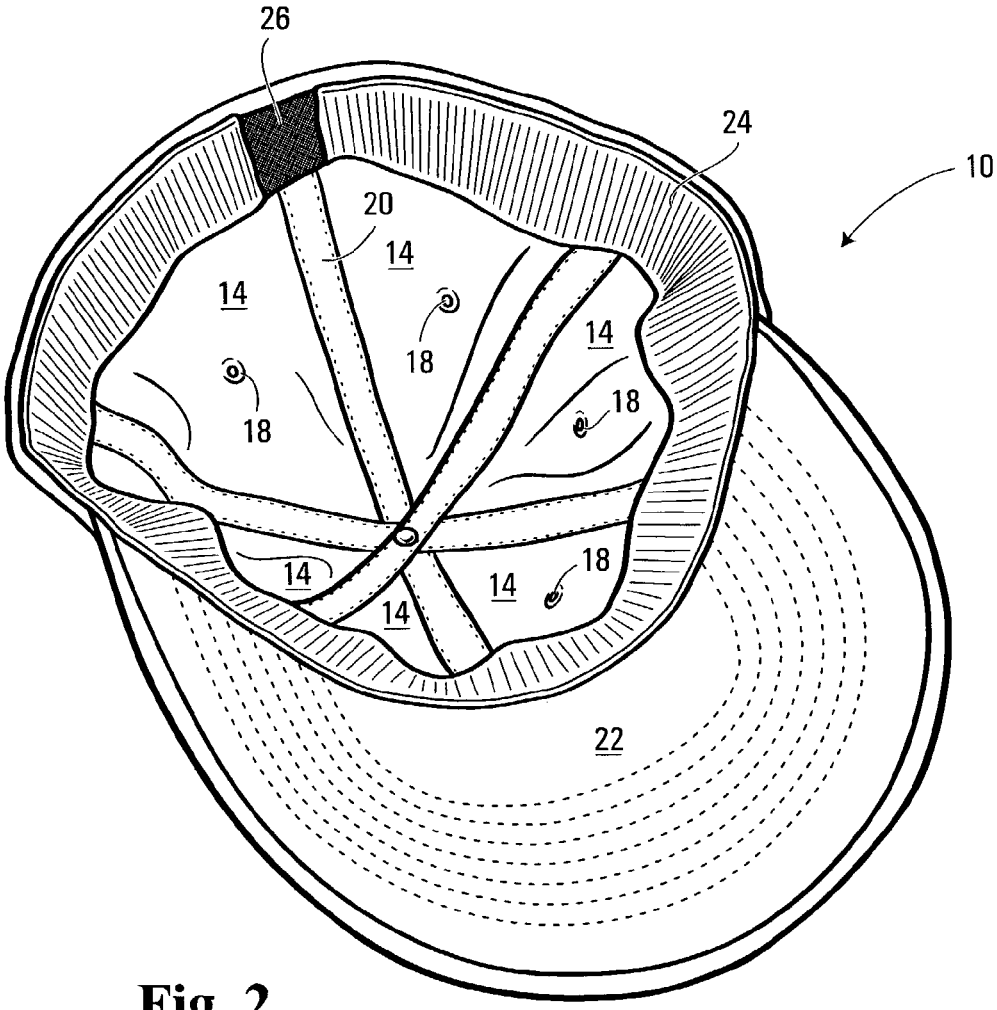
FIG. 2 a view of the hat of FIG. 1, from below.

FIGS. 1 and 2 illustrate a hat in the form of baseball cap 10, exemplary of an embodiment of the present invention. Cap 10 includes a crown 12. Crown 12 is formed of a plurality of fabric gores 14. Adjacent gores are attached to each other at their edges by way of stitched seam 16. Fabric gores 14 may be made of non-resilient material or material that is resilient in one or more directions. That is, gores 14 may for example contain a nylon component providing resiliency of each gore in one or more direction, and thereby providing overall resiliency of crown 12. Optionally, fabric gores 14 may include breathing holes 18 to allow air flow to facilitates cooling of the interior of crown 12.

Seam covers 20 in the form of thin rectangular bands are sewn on the interior of crown 12 to cover and reinforce seams 16, as best illustrated in FIG. 2. Seam covers 20 extend from edge to edge of the outer periphery of crown 12, along its interior surface. A semi-rigid visor 22 is sewn to and extends from the front of crown 12.

Additionally, an elasticized band 24 is sewn about the periphery of crown 12. Exemplary band 24 retains cap 10 on a wearer's head when worn, and provides a comfortable interface between the wearer's head and the cap. Elasticized band 24 is preferably attached to the interior of crown 12 around the entire inner perimeter of the opening defined by crown 12, and extends into the crown's interior so as not to be visible when cap 10 is worn.

Insertion of band 24 into crown 12 is best illustrated in FIG. 2. Band 24 is illustrated prior to its insertion and attachment to crown 12 in FIG. 3. As illustrated, band 24 is generally rectangular in shape having a lengthwise extent. An exemplary band for a cap to be worn by an adult may be about 1.25"×18" (3.175 cm×46 cm). Of course, these dimensions may be varied depending on the size of the cap, and the desired width of the band. The distal ends of the lengthwise extending band 24 may be joined to each other. Preferably, these ends are joined by way of a small rectangular fabric patch 26, sown to opposite distal ends of band 24. Rectangular patch 26 may for example have a width of 1.25" (3.175 cm) and a length of 1" (2.5 cm). Preferably, the length of patch 26 is small in comparison to the length of band 24. Patch 26 should, for example, be no greater than 25% of the length of the elasticized band 24.

Figure 3:
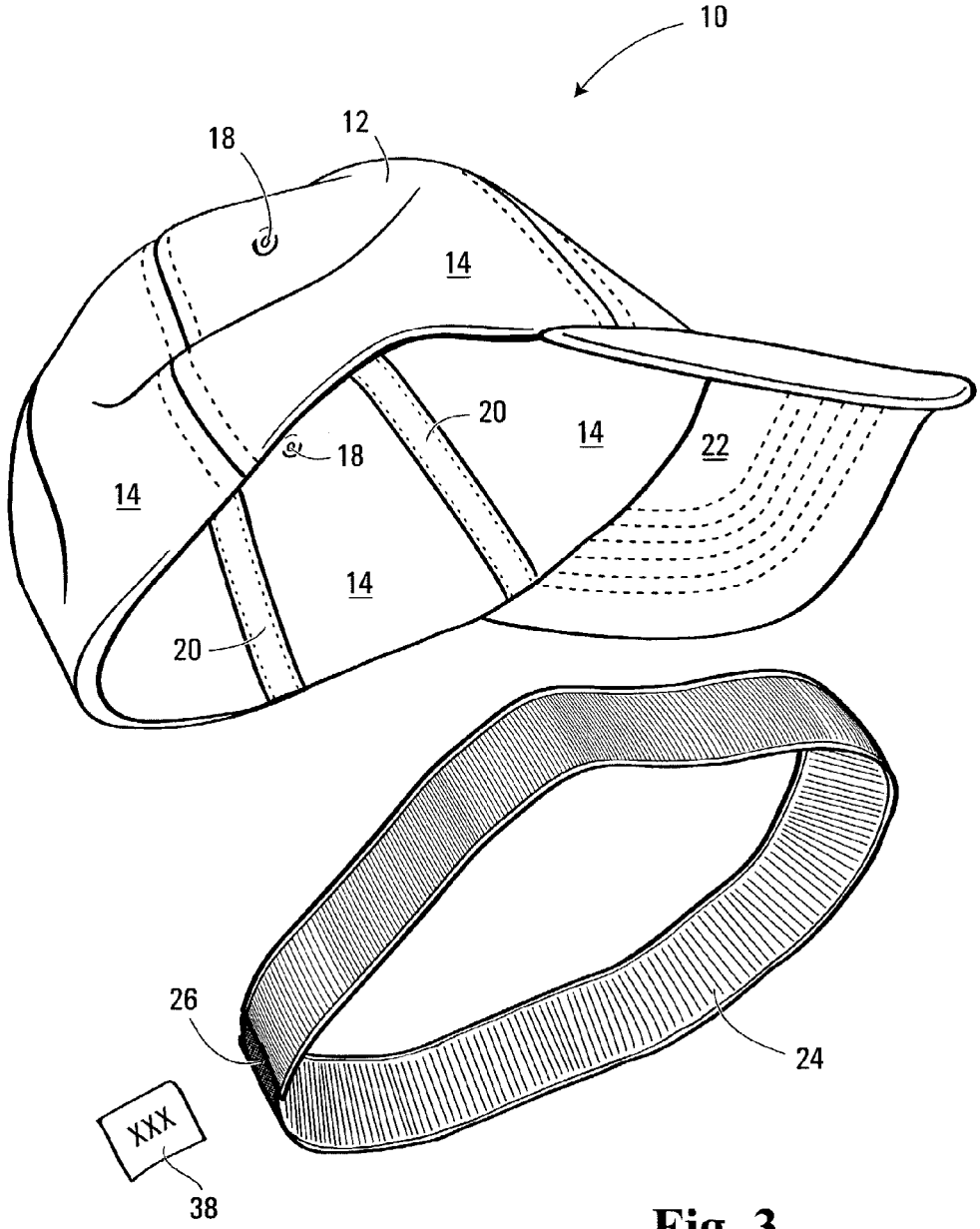
FIG. 3 is a partially exploded view of the hat of FIG. 1.
Figure 4:
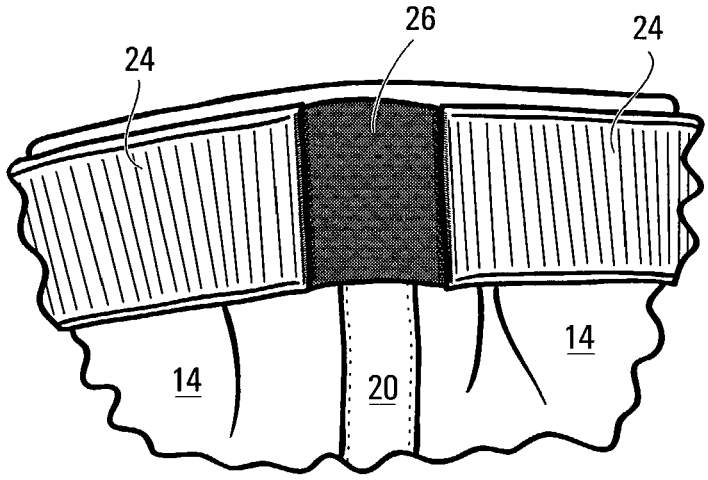
FIG. 4 is an enlarged view of a portion of the hat of FIG. 1.

In the exemplified embodiment, band 24 also absorbs perspiration. To that end, band 24 is at least partially formed of an absorbant material including cotton fibers and has a thickness of about 0.125" (3.5 mm). Conveniently, fabric patch 26 is made of material that is substantially thinner than band 24. When sewn on the inner periphery of crown 12, patch 26 is aligned to overlap with the seam 16 and seam cover 20 at the rear of cap 10. This is best illustrated in FIG. 4. As illustrated, the overlap of patch 26 with seam 16 and seam cover 20 significantly reduces the bulk of the fabric at this seam 16. This reduction in bulk further increases comfort to the wearer. Conveniently, patch 26 also provides an area to which a label 38, as depicted in FIG. 3, may be affixed, for example to indicate the origin of cap 10. Label 38 may overlap patch 26, and optionally a portion of band 24 near its distal ends. Alternatively, patch 26 may be treated as a label, and visual information may be printed, affixed or embossed thereon.

Figure 5:
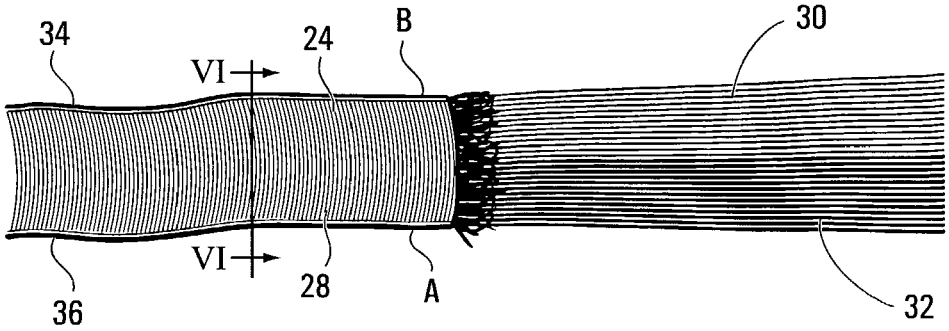
FIG. 5 is a plan view of a portion of an elasticized band forming part of the hat of FIG. 1.
Figure 6:
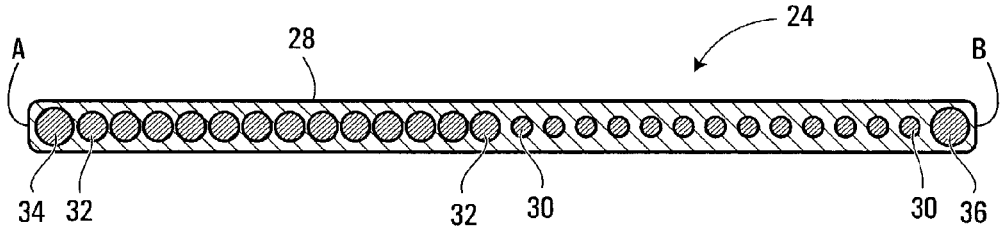
FIG. 6 is a cross-sectional view of the elasticized of FIG. 5 along VI—VI.

The structure and formation of band 24 may be better appreciated with reference to FIG. 5 illustrating the composition of band 24. Band 24 is shown frayed in FIG. 5 for the purposes of illustration only. Specifically, as illustrated, band 24 is made of a combination of fibers 28 that include an absorbing cotton component and may also include nylon, polyester and spandex components. Conveniently, the cotton absorbs perspiration. Fibers 28 may include cotton fibers and resilient fibers to provide resiliency in a direction perpendicular to the longitudinal extent of the band 24. Fibers 28 are woven laterally from edge to edge of band 24 and longitudinally along the length of hand 24. A plurality of elastic fibers 30, 32 are in turn webbed through fibers 28 to provide longitudinal resiliency of band 24. Optionally, the combination of fibers 28 may include sufficient resilient fibers so that band 24 is also resilient in a direction normal to the longitudinal extent of band 24. As illustrated, fibers 30, 32 are preferably generally parallel and extend within band 24 along its entire length. The resiliency of band 24 in a longitudinal direction is not uniform across its width. Instead, the longitudinal resiliency is greater in a first region proximate one edge A of band 24 than it is in a region proximate the opposite edge B. In the depicted embodiment, the first and second regions are each one lateral half of the band 24. In the depicted embodiment the difference in elasticity is achieved by using fibers 30, 32 of varying thickness, as illustrated in FIG. 6. Particularly, in this embodiment, the first region occupies one half of the width of band 24 proximate edge A and is populated with lengthwise extending rubber spandex bands, each, for example, having a diameter of 0.4667 mm. The second region occupies the other half of the band proximate edge B and is populated with smaller diameter rubber spandex bands, each for example having a diameter of 0.3175 mm. Additional retaining spandex bands 34 and 36 that extend lengthwise along band 24 are provided at the very edge of band 24. These retaining spandex bands 34 and 36 each have a diameter of 0.6047 mm.

The resulting band 24 is thus formed of approximately 42% polyester, 27% cotton, 19% elastic, and 12% nylon.

A person of ordinary skill will appreciate that varying longitudinal elasticity across the lateral extent of band 24 may be accomplished in numerous ways. For example, in addition to using different diameter spandex bands it might be possible to use equal diameter spandex bands having different modulus of elasticity. Alternatively, equal diameter spandex bands maybe used, but in different concentrations. Similarly, although only two regions of materially different elasticity are depicted, multiple regions are possible.

As for example illustrated in FIG. 1, band 24 is attached to the hat so that edge A of band 24 is positioned proximate the outer edge of the crown 12. Once cap 10 is completely assembled, as for example illustrated in FIGS. 1 and 2, cap 10 may be placed on the head of the wearer. Band 24 is preferably properly sized so that cap 10 fits snugly about the wearers head, and band 24 is tensioned when cap 10 is worn. As the elasticity of band 24 is greater near the outer edge of the opening of crown 12, band 24 does not grip the head of the wearer uniformly. Instead, the wearer's head is gripped more tightly by the region proximate edge A of band 24, and less tightly in the region proximate edge B. As a result, elasticized band 24 provides greater comfort to the wearer as it grips tightly near the outer edge of the crown, but less tightly near the interior edge A of band 24. At the same time, gripping along the entire area of band 24 keeps the band 24 proximate the wearer's head to absorb perspiration, and to retain cap 10. As noted, the reduced bulk of the cap near patch 26 further increases the overall comfort to the wearer.

As should now be appreciated, the invention could easily be embodied in a variety of hats differing from the disclosed embodiment. For example, a beret, toque, sun hat, visor or cap embodying aspects of the invention may easily be formed. Additionally, band 24 could also easily be used to provide a more comfortable fit to the wearer in other garments requiring elasticized bands, for example skirts, pants, undergarments, hosiery, jackets and the like.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

What is claimed is:

1. A hat comprising:

an elasticized band, having first and second opposing edges and a longitudinal extent, said elasticized band formed of a material to provide a first resiliency along a direction of said longitudinal extent, in a first region adjacent said first edge, and a second resiliency, differing from said first resiliency, along said longitudinal direction in a second region adjacent said second edge;

a crown defining a cavity to accommodate a wearer's head and having an interior surface and a lower peripheral edge;

said elasticized band attached proximate said lower peripheral edge, to extend along a periphery of said crown to elastically retain said hat when worn on a wearer's head and to grasp said wearer's head more tightly at said first region than at said second region.

2. The hat of claim 1, wherein said crown is made of a resilient fabric.

3. The hat of claim 1, wherein said first edge of said band is sewn to said lower peripheral edge and said elasticized band extends into said cavity, and said first resiliency is greater than said second resiliency.

4. The hat of claim 3, wherein said band further comprises cotton material extending between said first and second opposing edges, for absorbing perspiration.

5. The hat of claim 4, wherein said cotton material comprises cotton fibers and resilient fibers to provide resiliency at said band in a direction perpendicular to said longitudinal extent.

6. The hat of claim 3, wherein said band comprises approximately 42% polyester, 27% cotton, 19% elastic, and 12% nylon.

7. The hat of claim 1, wherein said elasticized band contains a non-uniform distribution of an elastic material.

8. The hat of claim 7, wherein said elasticized band contains rubber spandex strands.

9. The hat of claim 8, wherein said first and second regions contain an equal number of said rubber spandex strands, and wherein said rubber spandex strands in said first region have a diameter greater than a diameter of said rubber spandex strands in said second region.

10. The hat of claim 9, wherein, said diameter of said strands in said first region is approximately 0.47 millimeters, and said diameter of said strands in said second region is approximately 0.32 millimeters.

11. The hat of claim 7, wherein said first and second regions each occupy approximately one half the area of said band, and said second region comprises approximately 34% of said elastic material and said first region comprises approximately 66% of said elastic material.

12. The hat of claim 1, further comprising: a fabric patch, having a thickness less than a thickness of said band, and connecting distal ends of said band.

13. The hat of claim 12, wherein said crown is formed of a plurality of gores, interconnected at seams, and wherein said fabric patch overlaps one of said seams to reduce a bulk of material at said one of said seams.

14. The hat of claim 13, wherein each of said gores is made of a resilient fabric.

15. The hat of claim 8, wherein said first region contains a higher number of said rubber spandex strands than said second band region.

16. The hat of claim 8 wherein, said first and second regions contain an elastic material, and said first region contains more of said elastic material than said second region.

17. The hat of claim 12, wherein said patch: has a width approximately equal to chat of said elasticized band, and a length of approximately 2.5 centimeters.

18. An elasticized band for retaining garments on a wearer, comprising:

a first lengthwise extending band portion having a first elasticity in a lengthwise direction, and extending from a first edge of said band;

a second lengthwise extending band portion, extending directly from said first band portion along its length to a second edge of said band, and having a second elasticity in a lengthwise direction; said first elasticity being of tighter contraction than said second elasticity;

wherein said first and second band portions are of approximately equal widths.

19. An elasticized band for retaining garments on a wearer, containing elasticized material, said band comprising:

first lengthwise extending band portion having a first elasticity in a lengthwise direction, and extending from a first edge of said band;

a second lengthwise extending band portion, extending directly from said first band portion along its length to a second edge of said band, and having a second elasticity in a lengthwise direction; said first elasticity being of tighter contraction than said second elasticity;

wherein said first band portion comprises approximately 66% of said elastic material; and said second band portion comprises approximately 34% of said elastic material.

20. A hat comprising:

an elasticized band, having first and second opposing edges, a longitudinal extent and first and second distal ends, a crown defining a cavity to accommodate a wearer's head and having an interior surface and a lower peripheral edge, said elasticized band attached proximate said lower peripheral edge, to extend along a periphery of said crown to elastically retain said hat when worn on a wearer's head, a fabric patch, having thickness less than a thickness of said elasticized band, and connecting said first and second distal ends of said band, said fabric patch having a length of no more than 25% of said longitudinal extent of said elasticized band.

21. A hat according to claim 21, wherein said crown is formed of a plurality of gores, interconnected at seams, and wherein said fabric patch overlaps one of said seams to reduce a bulk of material at said one of said seams.

* * * * *

UNITED STATES PATENT AND TRADEMARK OFFICE

CERTIFICATE OF CORRECTION

PATENT NO. : 7,020,900 B2
APPLICATION NO. : 10/412468
DATED : April 4, 2006
INVENTOR(S) : Jacky Ngan It is certified that error appears in the above-identified patent and that said Letters Patent is hereby corrected as shown below:

Column 5
Line 48, replace “chat” with -- that --

Column 6
Line 16, replace “first lengthwise” with -- a first lengthwise --
Line 44, replace “according to claim 21” with -- according to claim 20 --

Column 6
Line 48, insert -- 22. A hat according to claim 21, further comprising a label covering said fabric patch. --

Signed and Sealed this

Twenty-sixth Day of June, 2007

JON W. DUDAS
*Director of the United States Patent and Trademark Office*